US012158269B2

(12) United States Patent
Ito et al.

(10) Patent No.: US 12,158,269 B2
(45) Date of Patent: Dec. 3, 2024

(54) COMBUSTION DEVICE COMPRISING PLURAL SWIRLING BLADES AND GAS TURBINE SYSTEM HAVING THE SAME

(71) Applicant: IHI Corporation, Tokyo (JP)

(72) Inventors: Shintaro Ito, Tokyo (JP); Masahiro Uchida, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 18/463,016

(22) Filed: Sep. 7, 2023

(65) Prior Publication Data

US 2023/0417414 A1 Dec. 28, 2023

Related U.S. Application Data

(63) Continuation of application No. PCT/JP2022/008007, filed on Feb. 25, 2022.

(30) Foreign Application Priority Data

Mar. 25, 2021 (JP) ..... 2021-051545

(51) Int. Cl.
*F23R 3/14* (2006.01)
*F23R 3/28* (2006.01)

(52) U.S. Cl.
CPC ..... *F23R 3/14* (2013.01); *F23R 3/286* (2013.01)

(58) Field of Classification Search
CPC ..... F23R 3/14; F23R 3/286
See application file for complete search history.

(56) References Cited

U.S. PATENT DOCUMENTS 3,915,387 A * 10/1975 Caruel ..... F23R 3/14 239/404
5,590,529 A * 1/1997 Joshi ..... F23D 14/02 60/737

(Continued)

FOREIGN PATENT DOCUMENTS

FR 3116592 A1 * 5/2022
JP 2006-300448 A 11/2006

(Continued)

*Primary Examiner* — William H Rodriguez
(74) *Attorney, Agent, or Firm* — Rothwell, Figg, Ernst & Manbeck, P.C.

(57) ABSTRACT

A combustion device includes: a combustion chamber; a plurality of hydrogen injection holes facing inside of the combustion chamber; a first air injection hole facing the inside of the combustion chamber and extending in the circumferential direction on a radially outer side with respect to the plurality of hydrogen injection holes; a second air injection hole facing the inside of the combustion chamber and extending in the circumferential direction on a radially inner side with respect to the plurality of hydrogen injection holes, the first and second air injection holes being annular; first swirling blades provided in the first air injection hole and inclined in the circumferential direction with respect to a combustion-chamber-side axial direction; and second swirling blades provided in the second air injection hole and inclined to the same side as the first swirling blades in the circumferential direction with respect to the combustion-chamber-side axial direction.

15 Claims, 13 Drawing Sheets

(56) References Cited

U.S. PATENT DOCUMENTS 7,669,421 B2 * 3/2010 Saitoh ..... F23R 3/14 60/737
11,668,466 B2 * 6/2023 Chon ..... F23R 3/286 60/722
11,873,761 B2 * 1/2024 Watase ..... F23R 3/343
2006/0236700 A1 * 10/2006 Saitoh ..... F23R 3/14 60/737
2007/0137207 A1 * 6/2007 Mancini ..... F23R 3/286 60/737
2007/0169486 A1 * 7/2007 Hernandez ..... F23R 3/286 60/737
2007/0227156 A1 * 10/2007 Saito ..... F02C 3/14 60/772
2007/0277528 A1 * 12/2007 Homitz ..... F23D 14/08 60/737
2009/0031728 A1 2/2009 Miura et al.
2010/0050644 A1 * 3/2010 Pidcock ..... F23R 3/343 60/737
2012/0024985 A1 * 2/2012 Johnson ..... F23R 3/14 29/890.12
2012/0094239 A1 4/2012 Miura et al.
2012/0260664 A1 * 10/2012 Harding ..... F02C 7/266 60/740
2013/0020413 A1 * 1/2013 Jones ..... F23D 11/383 239/533.2
2014/0033722 A1 * 2/2014 Abdel-Hafez ..... F23C 7/004 29/889.22
2014/0083100 A1 * 3/2014 Cunha ..... F23R 3/286 60/737
2014/0241871 A1 * 8/2014 Gregory ..... F23R 3/14 415/208.1
2015/0040572 A1 * 2/2015 Tseng ..... F23R 3/286 60/752
2016/0003478 A1 * 1/2016 Propheter-Hinckley ..... F23R 3/06 60/737
2017/0184308 A1 * 6/2017 Valeev ..... F23D 14/48
2017/0356656 A1 12/2017 Ogata et al.
2018/0298824 A1 * 10/2018 Matsuyama ..... F23R 3/343
2020/0025386 A1 * 1/2020 Muldal ..... F23R 3/343
2020/0284431 A1 9/2020 Ishihara et al.
2021/0010674 A1 * 1/2021 Thariyan ..... F23R 3/14
2022/0018542 A1 * 1/2022 Chon ..... F23R 3/14
2022/0120222 A1 * 4/2022 Watase ..... F23R 3/28
2023/0213191 A1 * 7/2023 Vukanti ..... F23R 3/28 60/752
2023/0408093 A1 * 12/2023 Gandikota ..... F23R 3/14

FOREIGN PATENT DOCUMENTS

JP 2011-94573 A 5/2011
JP 4959620 B2 6/2012
JP 2015-014400 A 1/2015
JP 2020-143888 A 9/2020
WO 2016/104725 A1 12/2017

* cited by examiner

COMBUSTION DEVICE COMPRISING PLURAL SWIRLING BLADES AND GAS TURBINE SYSTEM HAVING THE SAME

CROSS REFERENCE TO RELATED APPLICATIONS

This application is a continuation application of International Application No. PCT/JP2022/008007, filed on Feb. 25, 2022, which claims priority to Japanese Patent Application No. 2021-051545, filed on Mar. 25, 2021, the entire contents of which are incorporated by reference herein.

BACKGROUND ART

Technical Field

The present disclosure relates to a combustion device and a gas turbine system. The present application claims the benefit of priority based on Japanese Patent Application No. 2021-051545 filed on Mar. 25, 2021, the content of which is incorporated herein.

Related Art

Gas turbine systems, with which power is obtained by combusting fuel in a combustor, are used. Some of the gas turbine systems use, for example, hydrogen as fuel as disclosed in Patent Literature 1. By using hydrogen as fuel, carbon dioxide emission is suppressed.

CITATION LIST

Patent Literature

Patent Literature 1: JP 2015-014400 A

SUMMARY

Technical Problem

The rate of combustion of hydrogen is quite high compared to the rate of combustion of other fuels such as natural gas. Therefore, similarly to the case where natural gas or the like is used as fuel, when the fuel and the air are mixed in advance and supplied from a burner to a combustion chamber of a combustor, in the case where hydrogen is used as the fuel, backfire (namely, a phenomenon in which the flame flows back into the burner) is likely to occur. In addition, the temperature of the flame formed by combustion of hydrogen is higher than the temperature of flames formed by combustion of other fuels. Therefore, the burner is easily eroded by the flame. Thus, there is a high need to protect the burner from the flame.

An object of the present disclosure is to provide a combustion device and a gas turbine system capable of protecting a burner from flame.

Solution to Problem

In order to solve the above problem, a combustion device according to the present disclosure includes: a combustion chamber; a plurality of hydrogen injection holes facing inside of the combustion chamber, the plurality of hydrogen injection holes included at intervals in a circumferential direction of the combustion chamber; a first air injection hole facing the inside of the combustion chamber and extending in the circumferential direction on a radially outer side with respect to the plurality of hydrogen injection holes, the first air injection hole being annular; a second air injection hole facing the inside of the combustion chamber and extending in the circumferential direction on a radially inner side with respect to the plurality of hydrogen injection holes, the second air injection hole being annular; a first swirling blade provided in the first air injection hole and inclined in the circumferential direction with respect to a combustion-chamber-side axial direction, the combustion-chamber-side axial direction being a part of an axial direction of the combustion chamber, the part facing the combustion chamber; and a second swirling blade provided in the second air injection hole and inclined to a same side as the first swirling blade in the circumferential direction with respect to the combustion-chamber-side axial direction.

A pair of injection hole groups each having the plurality of hydrogen injection holes, the first air injection hole, and the second air injection hole may be included at an interval in a radial direction of the combustion chamber, and a direction in which the first swirling blade and the second swirling blade are inclined with respect to the combustion-chamber-side axial direction in one of the injection hole groups and a direction in which the first swirling blade and the second swirling blade are inclined with respect to the combustion-chamber-side axial direction in the other injection hole group may be on different sides in the circumferential direction.

A pair of injection hole groups each having the plurality of hydrogen injection holes, the first air injection hole, and the second air injection hole may be included at an interval in a radial direction of the combustion chamber, and a direction in which the first swirling blade and the second swirling blade are inclined with respect to the combustion-chamber-side axial direction in one of the injection hole groups and a direction in which the first swirling blade and the second swirling blade are inclined with respect to the combustion-chamber-side axial direction in the other injection hole group may be on a same side in the circumferential direction.

A third air injection hole may be further included, the third air injection hole provided on a radially inner side with respect to an injection hole group including the plurality of hydrogen injection holes, the first air injection hole, and the second air injection hole, the third air injection hole facing the inside of the combustion chamber.

The third air injection hole may extend in the circumferential direction and be formed in an annular shape, and the third air injection hole may be provided with a third swirling blade inclined in the circumferential direction with respect to the combustion-chamber-side axial direction.

The direction in which the third swirling blade is inclined with respect to the combustion-chamber-side axial direction in the third air injection hole and the direction in which the first swirling blade and the second swirling blade are inclined with respect to the combustion-chamber-side axial direction in the injection hole group adjacent to the third air injection hole may be on different sides in the circumferential direction.

A burner plate closing an end of the combustion chamber may be included, and an injection hole group including a plurality of hydrogen injection holes, a first air injection hole, and a second air injection hole may be formed in the burner plate.

A manifold communicating with the plurality of hydrogen injection holes may be formed in the burner plate.

In order to solve the above disadvantage, a gas turbine system of the present disclosure includes the combustion device described above.

Effects of Disclosure

According to the present disclosure, a burner can be protected from flame.

DESCRIPTION OF EMBODIMENTS

Embodiments of the present disclosure will be described below by referring to the accompanying drawings. Dimensions, materials, other specific numerical values, and the like illustrated in the embodiments are merely an example for facilitating understanding, and the present disclosure is not limited thereto unless otherwise specified. Note that, in the present specification and the drawings, components having substantially the same function and structure are denoted by the same symbol, and redundant explanations are omitted. Illustration of components not directly related to the present disclosure is omitted.

Figure 1:
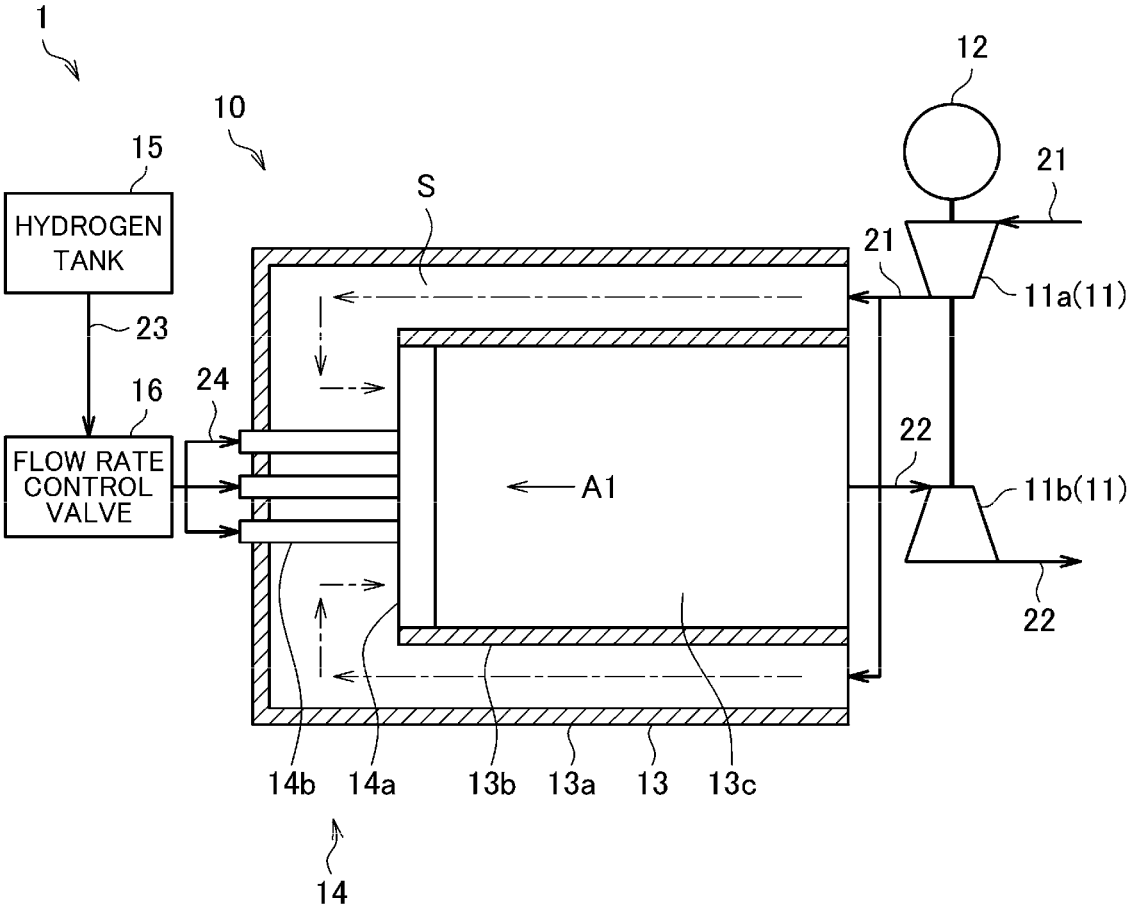
FIG. 1 is a schematic diagram illustrating a configuration of a gas turbine system according to an embodiment of the present disclosure.

FIG. 1 is a schematic diagram illustrating a configuration of a gas turbine system 1 according to the present embodiment. As illustrated in FIG. 1, the gas turbine system 1 includes a turbocharger 11, a generator 12, a combustor 13, a burner 14, a hydrogen tank 15, and a flow rate control valve 16.

In the gas turbine system 1, the combustor 13, the burner 14, the hydrogen tank 15, and the flow rate control valve 16 are included in a combustion device 10.

The turbocharger 11 includes a compressor 11*a* and a turbine 11*b*. The compressor 11*a* and the turbine 11*b* rotate in an integrated manner. The compressor 11*a* and the turbine 11*b* are connected by a shaft.

The compressor 11*a* is provided in an intake flow path 21 connected with the combustor 13. The air supplied to the combustor 13 flows through the intake flow path 21. An intake port (not illustrated) through which the air is taken in from the outside is provided at an upstream end of the intake flow path 21. The air taken in from the intake port passes through the compressor 11*a* and is sent to the combustor 13. The compressor 11*a* compresses the air and discharges the air to the downstream side.

The turbine 11*b* is provided in an exhaust flow path 22 connected with the combustor 13. Exhaust gas discharged from the combustor 13 flows through the exhaust flow path 22. An exhaust port (not illustrated) through which the exhaust gas is discharged to the outside is provided at a downstream end of the exhaust flow path 22. The exhaust gas discharged from the combustor 13 passes through the turbine 11*b* and is sent to the exhaust port. The turbine 11*b* generates rotational power by being turned by the exhaust gas.

The generator 12 is connected with the turbocharger 11. The generator 12 generates electric power using the rotational power generated by the turbocharger 11.

The combustor 13 includes a casing 13*a*, a liner 13*b*, and a combustion chamber 13*c*. The casing 13*a* has a substantially cylindrical shape. The liner 13*b* is included inside the casing 13*a*. The liner 13*b* has a substantially cylindrical shape. The liner 13*b* is disposed coaxially with the casing 13*a*. The combustion chamber 13*c* is formed inside the liner 13*b*. That is, the internal space of the liner 13*b* corresponds to the combustion chamber 13*c*. The combustion chamber 13*c* is a substantially cylindrical space. The exhaust flow path 22 is connected to the combustion chamber 13*c*.

As described later, hydrogen and the air are supplied to the combustion chamber 13*c*. In the combustion chamber 13*c*, hydrogen is used as fuel, and combustion is performed. The exhaust gas generated by the combustion in the combustion chamber 13*c* is discharged to the exhaust flow path 22. A space S is formed between the inner surface of the casing 13*a* and the outer surface of the liner 13*b*. The intake flow path 21 is connected to the space S. The air is supplied from the compressor 11*a* to the space S via the intake flow path 21. An opening is formed at an end (an end on the left side in FIG. 1) of the liner 13*b*. The burner 14 is inserted through the opening at the end of the liner 13*b*.

The burner 14 includes a burner plate 14*a* and a plurality of hydrogen supply pipes 14*b*. The burner plate 14*a* closes the opening at the end of the liner 13*b*. That is, the burner plate 14*a* closes the end of the combustion chamber 13*c*. The burner plate 14*a* has a disk shape. The hydrogen supply pipes 14*b* are connected to a surface of the burner plate 14*a* on a side opposite to the combustion chamber 13*c* side. The hydrogen supply pipes 14*b* penetrate the casing 13*a* and extend to the outside of the casing 13*a*. In FIG. 1, three hydrogen supply pipes 14*b* are illustrated. However, the number of hydrogen supply pipes 14*b* is not limited.

In the burner plate 14*a*, as described later with reference to FIGS. 2 to 5, hydrogen injection holes (specifically, hydrogen injection holes 31 to be described later) and air injection holes (specifically, a first air injection hole 32 and a second air injection hole 33 to be described later) are formed. The hydrogen injection holes formed in the burner plate 14*a* communicate with the hydrogen supply pipes 14*b*. Hydrogen is sent to the hydrogen supply pipes 14*b* as described later. Hydrogen sent from the hydrogen supply pipes 14*b* to the burner plate 14*a* passes through the hydrogen injection holes of the burner plate 14*a* and is injected into the combustion chamber 13*c*. As indicated by an alternate long and short dash line arrow in FIG. 1, the air sent to the space S passes through the space S and then reaches a surface of the burner plate 14*a* on the side opposite to the combustion chamber 13*c*. The air sent to the burner plate 14*a* passes through the air injection holes of the burner plate 14*a* and is injected into the combustion chamber 13*c*.

Hydrogen is stored in the hydrogen tank 15. Note that, in the hydrogen tank 15, hydrogen may be liquid or gas. The hydrogen tank 15 is connected with the flow rate control valve 16 via a flow path 23. The flow rate control valve 16 is connected with each of the hydrogen supply pipes 14*b* of the burner 14 via flow paths 24. Hydrogen stored in the hydrogen tank 15 is supplied to the hydrogen supply pipes 14*b* via the flow path 23, the flow rate control valve 16, and the flow paths 24. The flow rate control valve 16 controls (namely, adjusts) a flow rate of hydrogen supplied from the hydrogen tank 15 to the hydrogen supply pipes 14*b*. With the opening degree of the flow rate control valve 16 adjusted, the amount of hydrogen supplied from the hydrogen tank 15 to the hydrogen supply pipes 14*b* is adjusted.

Hereinafter, the circumferential direction of the combustion chamber 13*c* is also simply referred to as a circumferential direction. The radial direction of the combustion chamber 13*c* is also simply referred to as a radial direction. The axial direction of the combustion chamber 13*c* is also simply referred to as an axial direction.

Figure 2:
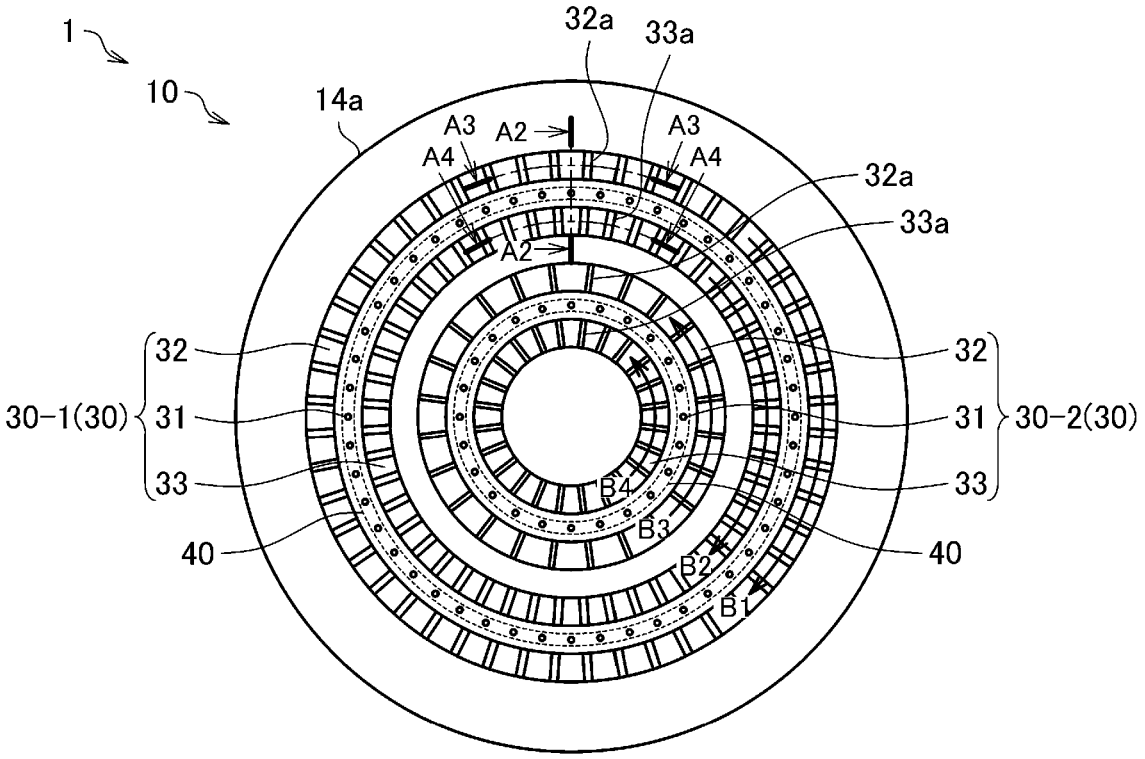
FIG. 2 is a diagram of a burner plate according to the embodiment of the present disclosure as viewed from a combustion chamber side.
Figure 3:
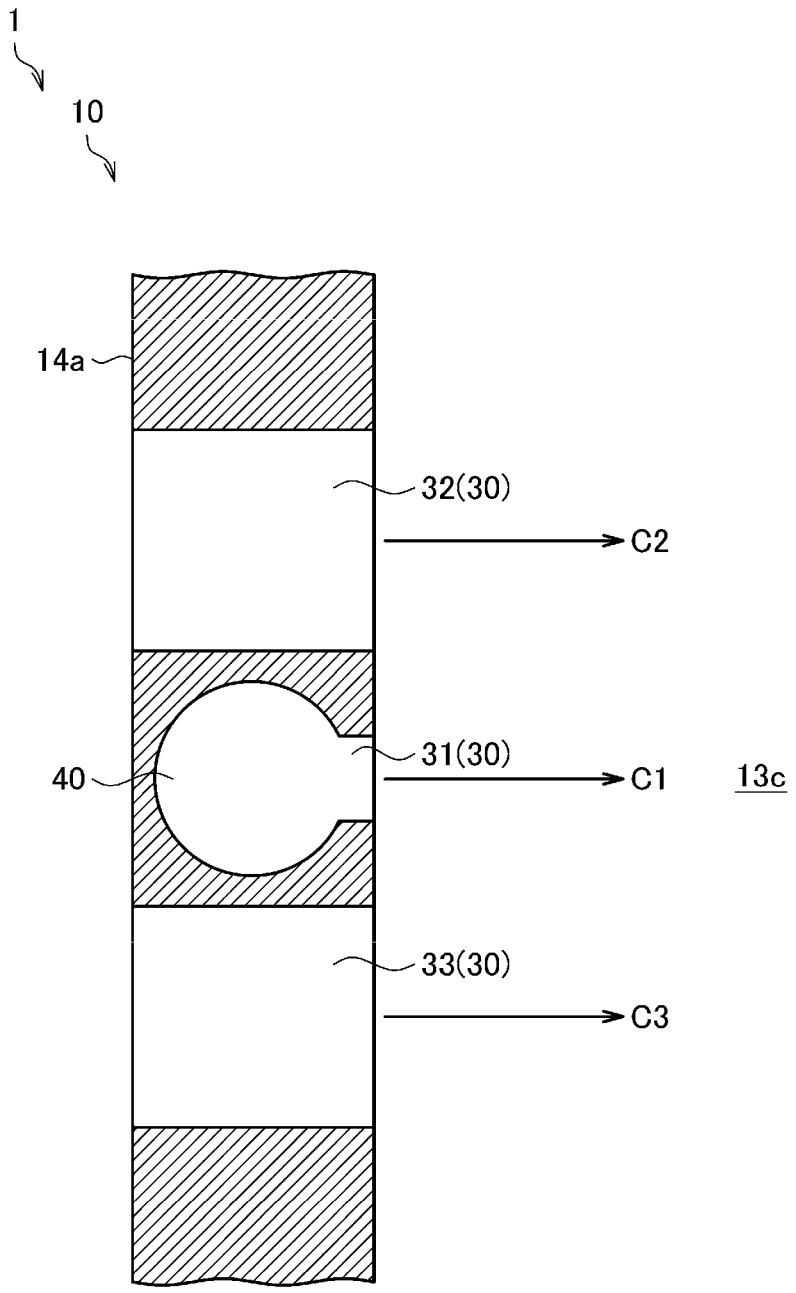
FIG. 3 is a cross-sectional view taken along line A2-A2 in FIG. 2.
Figure 4:
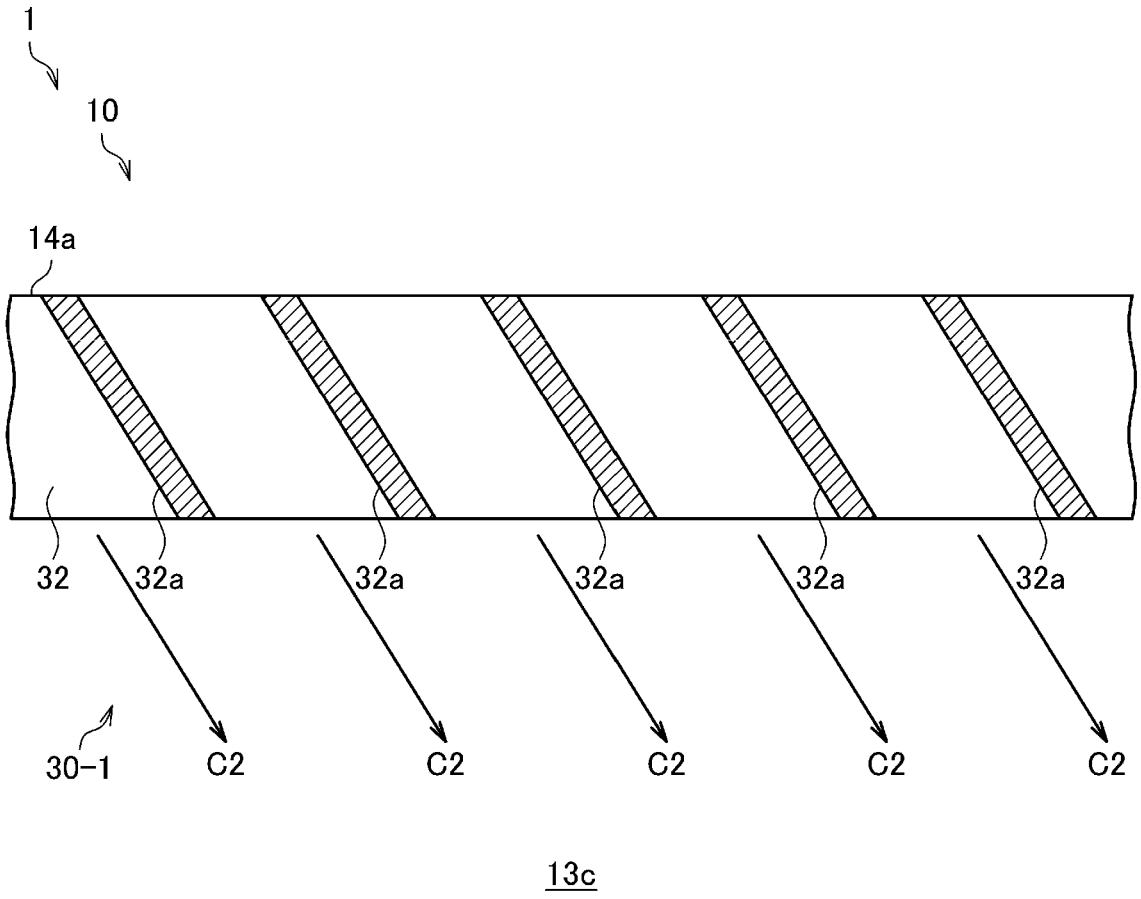
FIG. 4 is a cross-sectional view taken along line A3-A3 in FIG. 2.
Figure 5:
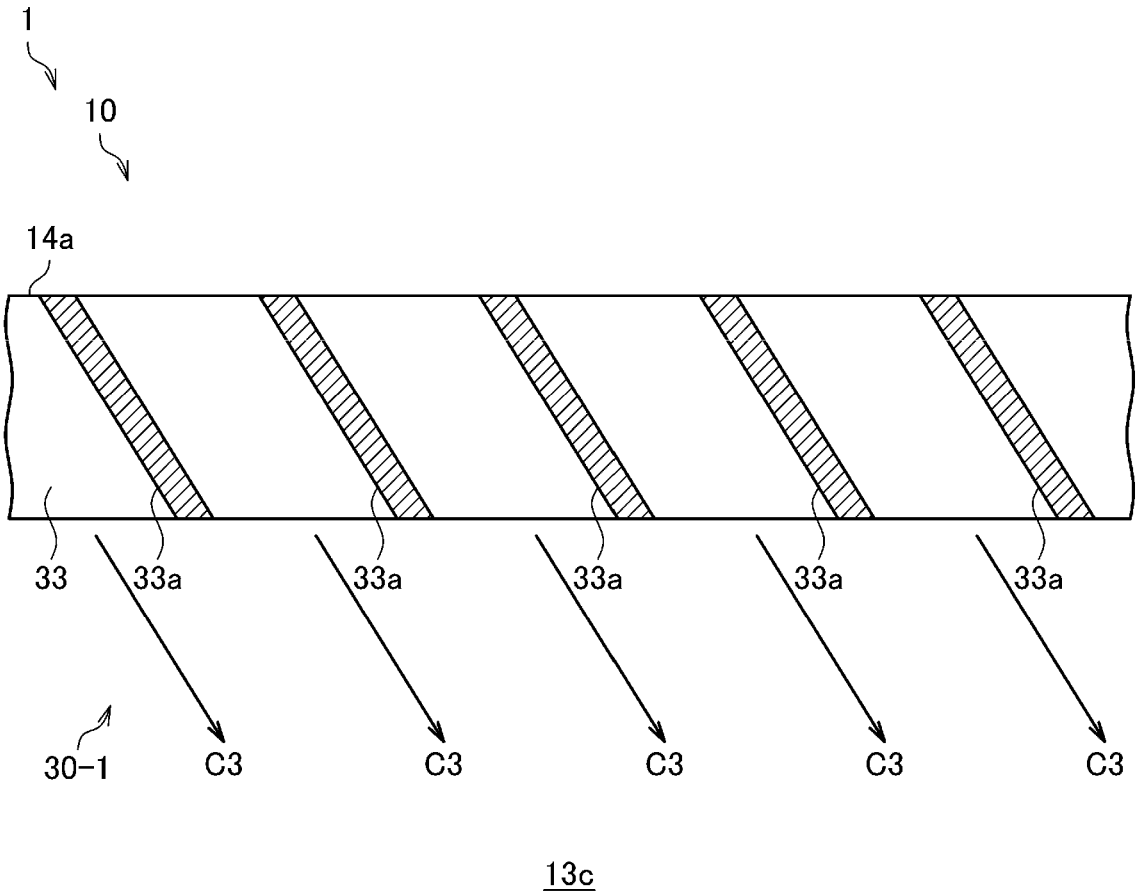
FIG. 5 is a cross-sectional view taken along line A4-A4 in FIG. 2.

FIG. 2 is a diagram of the burner plate 14*a* as viewed from the combustion chamber 13*c* side (specifically, diagram as viewed from a direction of an arrow A1 in FIG. 1). FIG. 3 is a cross-sectional view taken along line A2-A2 in FIG. 2. FIG. 4 is a cross-sectional view taken along line A3-A3 in FIG. 2. FIG. 5 is a cross-sectional view taken along line A4-A4 in FIG. 2.

As illustrated in FIG. 2, a pair of injection hole groups (specifically, an injection hole group 30-1 and an injection hole group 30-2) is formed in the burner plate 14*a*. Each of the injection hole groups 30 has a plurality of hydrogen injection holes 31, a first air injection hole 32, and a second air injection hole 33. Each of the injection hole groups 30 extends in the circumferential direction and has an annular shape. The injection hole group 30-1 is disposed on a radially outer side with respect to the injection hole group 30-2. In this manner, the injection hole group 30-1 and the injection hole group 30-2 are included at an interval in the radial direction. However, the number of injection hole groups 30 formed in the burner plate 14*a* is not limited to this example. For example, the number of injection hole groups 30 formed in the burner plate 14*a* may be one or three or more.

The hydrogen injection holes 31 face the inside of the combustion chamber 13*c*. The hydrogen injection holes 31 opens on a surface of the burner plate 14*a* on the combustion chamber 13*c* side. In each of the injection hole groups 30, the plurality of hydrogen injection holes 31 is included at intervals in the circumferential direction. In each of the injection hole groups 30, the hydrogen injection holes 31 are included at equal intervals. However, in each of the injection hole groups 30, the hydrogen injection holes 31 may be included at unequal intervals.

In the burner plate 14*a*, a manifold 40 communicating with a plurality of hydrogen injection holes 31 is formed for each of the injection hole groups 30. The manifolds 40 extend in the circumferential direction. The manifolds 40 are formed, for example, in an annular shape. As illustrated in FIGS. 2 and 3, a manifold 40 is provided side by side in the axial direction of the combustion chamber 13*c* with the plurality of hydrogen injection holes 31 of each of the injection hole groups 30. A manifold 40 is disposed on the side opposite to the combustion chamber 13*c* side with respect to the plurality of hydrogen injection holes 31 of each of the injection hole groups 30. In the example of FIG. 3, the cross-sectional shape of the manifold 40 (specifically, the shape in the cross section orthogonal to the extending direction of the manifold 40) is circular. However, the cross-sectional shape of the manifold 40 may be other than circular (such as a polygonal shape).

The hydrogen supply pipes 14*b* of the burner 14 are connected to the manifolds 40. Hydrogen is supplied from the hydrogen supply pipes 14*b* to each of the manifolds 40. The hydrogen supplied to the manifolds 40 is injected from each of the hydrogen injection holes 31 to the combustion chamber 13*c* as indicated by an arrow C1 in FIG. 3. Hydrogen supplied to the manifold 40 provided for the injection hole group 30-1 is injected from the plurality of hydrogen injection holes 31 of the injection hole group 30-1 to the combustion chamber 13*c*. Hydrogen supplied to the manifold 40 provided for the injection hole group 30-2 is injected from the plurality of hydrogen injection holes 31 of the injection hole group 30-2 to the combustion chamber 13*c*.

The first air injection holes 32 face the inside of the combustion chamber 13*c*. The first air injection holes 32 penetrate the burner plate 14*a* from the combustion chamber 13*c* side to the opposite side to the combustion chamber 13*c* side. In each of the injection hole groups 30, the first air injection hole 32 is included on a radially outer side with respect to the plurality of hydrogen injection holes 31. The first air injection hole 32 extends in the circumferential direction and is formed in an annular shape. A part of the air sent to the burner plate 14*a* through the space S in the combustor 13 is injected from the first air injection hole 32 into the combustion chamber 13*c* as indicated by an arrow C2 in FIGS. 3 and 4.

The first air injection hole 32 is provided with first swirling blades 32*a* inclined in the circumferential direction with respect to the combustion-chamber-side axial direction. The combustion-chamber-side axial direction is a direction facing the combustion chamber 13*c* in the axial direction of the combustion chamber 13*c*. To be inclined in the circumferential direction with respect to the combustion-chamber-side axial direction means to extend in a direction of a vector obtained by combining a vector in the circumferential direction with a vector in the combustion-chamber-side axial direction or to be inclined so as to advance in the circumferential direction as it is closer to the combustion chamber 13*c*. The first swirling blades 32*a* have, for example, a substantially flat plate shape. A first swirling blade 32*a* divides the first air injection hole 32 in the circumferential direction. A first swirling blade 32*a* extends on a plane intersecting the circumferential direction. In each of the first air injection holes 32, a plurality of first swirling blades 32*a* is provided at intervals in the circumferential direction. In each of the first air injection holes 32, the plurality of first swirling blades 32*a* is provided at equal intervals. However, in each of the first air injection holes 32, the plurality of first swirling blades 32*a* may be provided at unequal intervals.

For example, as illustrated in FIG. 4, in the first air injection hole 32 of the injection hole group 30-1, the first swirling blades 32*a* are inclined to a first side (clockwise direction in FIG. 2) in the circumferential direction with respect to the combustion-chamber-side axial direction. An injection direction of the air injected from the first air injection hole 32 is a direction along the first swirling blades 32*a*. Therefore, as indicated by the arrow C2 in FIG. 4, the injection direction of the air injected from the first air injection hole 32 of the injection hole group 30-1 is a direction inclined to the first side in the circumferential direction with respect to the combustion-chamber-side axial direction. Therefore, as indicated by an arrow B1 in FIG. 2, the air injected from the first air injection hole 32 of the injection hole group 30-1 swirls to the first side in the circumferential direction in the combustion chamber 13*c*.

The second air injection holes 33 face the inside of the combustion chamber 13*c*. The second air injection holes 33 penetrate the burner plate 14*a* from the combustion chamber 13*c* side to the opposite side to the combustion chamber 13*c* side. In each of the injection hole groups 30, the second air injection hole 33 is included on a radially inner side with respect to the plurality of hydrogen injection holes 31. The second air injection hole 33 extends in the circumferential direction and is formed in an annular shape. A part of the air sent to the burner plate 14*a* through the space S in the combustor 13 is injected from the second air injection hole 33 into the combustion chamber 13*c* as indicated by an arrow C3 in FIGS. 3 and 5.

The second air injection hole 33 is provided with second swirling blades 33*a* inclined to the same side as the first swirling blades 32*a* (specifically, the first swirling blades 32*a* belonging to the same injection hole group 30) in the circumferential direction with respect to the combustion-chamber-side axial direction. The second swirling blades 33*a* have, for example, a substantially flat plate shape. A second swirling blade 33*a* divides the second air injection hole 33 in the circumferential direction. A second swirling blade 33*a* extends on a plane intersecting the circumferential direction. In each of the second air injection holes 33, a plurality of second swirling blades 33*a* is provided at intervals in the circumferential direction. In each of the second air injection holes 33, the plurality of second swirling blades 33*a* is provided at equal intervals. However, in each of the second air injection holes 33, the plurality of second swirling blades 33*a* may be provided at unequal intervals.

For example, as illustrated in FIG. 5, in the second air injection hole 33 of the injection hole group 30-1, the second swirling blades 33*a* are inclined to the first side (clockwise direction in FIG. 2) in the circumferential direction with respect to the combustion-chamber-side axial direction. An injection direction of the air injected from the second air injection hole 33 is a direction along the second swirling blades 33*a*. Therefore, as indicated by the arrow C3 in FIG. 5, the injection direction of the air injected from the second air injection hole 33 of the injection hole group 30-1 is a direction inclined to the first side in the circumferential direction with respect to the combustion-chamber-side axial direction. Therefore, as indicated by an arrow B2 in FIG. 2, the air injected from the second air injection hole 33 of the injection hole group 30-1 swirls to the first side in the circumferential direction in the combustion chamber 13*c*.

The direction in which the first swirling blades 32*a* and the second swirling blades 33*a* are inclined with respect to the combustion-chamber-side axial direction in the injection hole group 30-1 and the direction in which the first swirling blades 32*a* and the second swirling blades 33*a* are inclined with respect to the combustion-chamber-side axial direction in the injection hole group 30-2 are on different sides in the circumferential direction. That is, in the first air injection hole 32 of the injection hole group 30-2, the first swirling blades 32*a* are inclined to a second side in the circumferential direction (counterclockwise direction in FIG. 2) with respect to the combustion-chamber-side axial direction. Therefore, as indicated by an arrow B3 in FIG. 2, the air injected from the first air injection hole 32 of the injection hole group 30-2 swirls to the second side in the circumferential direction in the combustion chamber 13*c*. In the second air injection hole 33 of the injection hole group the second swirling blades 33*a* are inclined to the second side in the circumferential direction with respect to the combustion-chamber-side axial direction. Therefore, as indicated by an arrow B4 in FIG. 2, the air injected from the second air injection hole 33 of the injection hole group 30-2 swirls to the second side in the circumferential direction in the combustion chamber 13*c*.

As described above, in each of the injection hole groups 30, the first air injection hole 32 provided on a radially outer side with respect to the plurality of hydrogen injection holes 31 is provided with the first swirling blades 32*a* inclined in the circumferential direction with respect to the combustion-chamber-side axial direction. The second air injection hole 33 provided on a radially inner side with respect to the plurality of hydrogen injection holes 31 is provided with the second swirling blades 33*a* inclined to the same side as the first swirling blades 32*a* in the circumferential direction with respect to the combustion-chamber-side axial direction. As a result, the air injected from the first air injection hole 32 and the second air injection hole 33 swirls to the same side in the circumferential direction in the combustion chamber 13*c*. The hydrogen injected from the hydrogen injection holes 31 is injected toward a swirl flow of air generated in this manner. Therefore, the hydrogen injected from the hydrogen injection hole 31 is mixed with the air while swirling by the swirl flow of air.

As described above, according to the combustion device 10 of the gas turbine system 1, in each of the injection hole groups 30, the hydrogen injected from the hydrogen injection holes 31 is rapidly mixed with the air by the swirl flow of air generated by the air injected from the first air injection hole 32 and the second air injection hole 33. Therefore, the ignition position is on the inner side of the combustion chamber 13*c* as compared with a case where hydrogen and the air are supplied to the combustion chamber 13*c* in a state of having been mixed in advance. Therefore, backfire is suppressed. In addition, erosion of the burner 14 is suppressed. Therefore, the burner 14 can be protected from flame. In addition, by adjusting the supply amount of the air as appropriate and lowering the temperature of flame, the emission amount of NOx is also reduced.

In each of the injection hole groups 30, the inclination angles (namely, the inclination angle with respect to the combustion-chamber-side axial direction) of the first swirling blades 32*a* and the second swirling blades 33*a* may match or be different.

Figure 6:
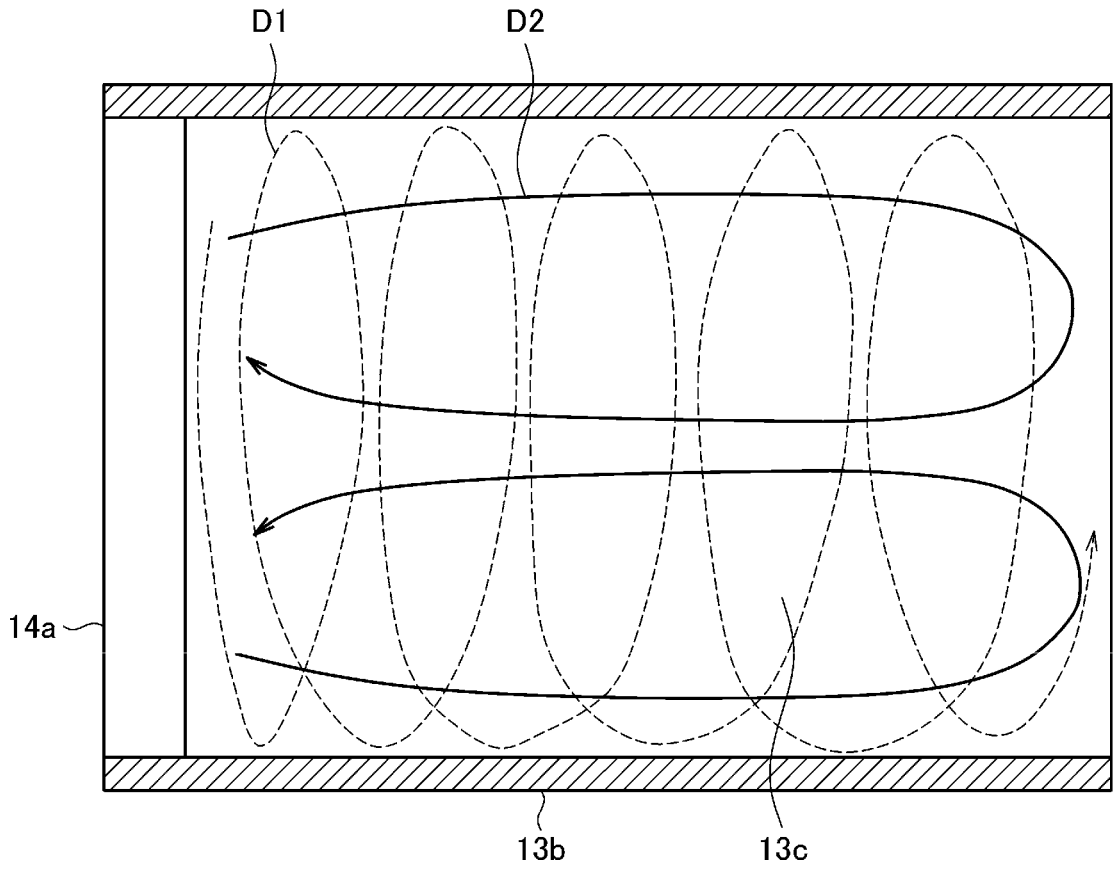
FIG. 6 is a schematic diagram illustrating the flow of gas generated in the combustion chamber according to the embodiment of the present disclosure.

FIG. 6 is a schematic diagram illustrating the flow of gas generated in the combustion chamber 13*c*. In FIG. 6, a swirl flow of air generated by the air injected from the first air injection hole 32 and the second air injection hole 33 is indicated by an arrow D1. When the swirl flow of air is generated, as indicated by an arrow D2, a circulating flow is generated which is a flow of gas passing through the vicinity of the central axis of the swirl flow (namely, through the vicinity of the central axis of the combustion chamber 13*c*) toward the burner plate 14*a* side.

In the combustion device 10, as described above, the direction in which the first swirling blades 32*a* and the second swirling blades 33*a* are inclined with respect to the combustion-chamber-side axial direction in the injection hole group 30-1 and the direction in which the first swirling blades 32*a* and the second swirling blades 33*a* are inclined with respect to the combustion-chamber-side axial direction in the injection hole group 30-2 are on different sides in the circumferential direction. As a result, the swirling direction (specifically, the clockwise direction in FIG. 2) of a swirl flow of air generated by the air injected from the injection hole group 30-1 and the swirling direction (specifically, the counterclockwise direction in FIG. 2) of a swirl flow of air generated by the air injected from the injection hole group 30-2 are opposite. Therefore, the swirl flow of air generated by the air injected from the injection hole group 30-1 and the swirl flow of air generated by the air injected from the injection hole group 30-2 weaken each other. Therefore, the circulating flow (namely, the flow indicated by the arrow D2 in FIG. 6) passing through the vicinity of the central axis of the swirl flow toward the burner plate 14*a* is weakened. This prevents flame from approaching the burner plate 14*a*. Therefore, erosion of the burner 14 is suppressed.

In the axial direction of the combustion chamber 13*c*, at a position where the swirl flow of air generated by the injection hole group 30-1 and the swirl flow of air generated by the injection hole group 30-2 interfere with each other, a local vortex is generated, whereby the gas injected from the injection hole group 30-1 and the gas injected from the injection hole group 30-2 are easily mixed. Thus, the amount of NOx emission is further reduced.

In the above example, the first swirling blades 32*a* and the second swirling blades 33*a* of the injection hole group are inclined to the first side (clockwise direction in FIG. 2) in the circumferential direction with respect to the combustion-chamber-side axial direction. However, the first swirling blades 32*a* and the second swirling blades 33*a* of the injection hole group 30-1 may be inclined to the second side in the circumferential direction (counterclockwise direction in FIG. 2) with respect to the combustion-chamber-side axial direction. In this case, the first swirling blades 32*a* and the second swirling blades 33*a* of the injection hole group are inclined to the first side in the circumferential direction with respect to the combustion-chamber-side axial direction.

In the combustion device 10, the injection hole groups 30 are formed in the burner plate 14*a* that closes the end of the combustion chamber 13*c*. Therefore, the injection hole groups can be easily formed by integrally molding the burner plate 14*a* by metal lamination technology or the like. By integrally molding the burner plate 14*a* in this manner, the structure of the burner 14 is simplified, the burner 14 is downsized, and the manufacturing cost of the burner 14 is reduced as compared with the case where the members forming the injection hole groups 30 are separate from the burner plate 14*a*. In addition, leakage of hydrogen from joint portions of members is suppressed. Furthermore, the occurrence of a crack at joint portions due to thermal stress is suppressed.

In the combustion device 10, the manifolds 40 communicating with the plurality of hydrogen injection holes 31 are formed in the burner plate 14*a*. Therefore, the manifolds 40 can be easily formed by integrally molding the burner plate 14*a* by metal lamination technology or the like. By integrally molding the burner plate 14*a* in this manner, the structure of the burner 14 is simplified, the burner 14 is downsized, and the manufacturing cost of the burner 14 is reduced as compared with the case where the members forming the manifolds 40 are separate from the burner plate 14*a*. In addition, leakage of hydrogen from joint portions of members is suppressed. Furthermore, the occurrence of a crack at joint portions due to thermal stress is suppressed.

Note that each of divided portions (for example, each of portions obtained by dividing at predetermined angles in the circumferential direction) of the burner plate 14*a* may be integrally molded by metal lamination technology or the like, and the obtained members may be assembled. Also in this case, the manufacturing cost of the burner 14 is reduced, leakage of hydrogen from joint portions of the member is suppressed, and occurrence of a crack in the joint portions due to thermal stress is suppressed.

Hereinafter, a gas turbine system according to each modification will be described with reference to FIGS. 7 to 11. Note that, in a gas turbine system according to each modification described below, the configuration other than that of the burner plate is similar to that of the gas turbine system 1 described above, and thus description thereof is omitted.

Figure 7:
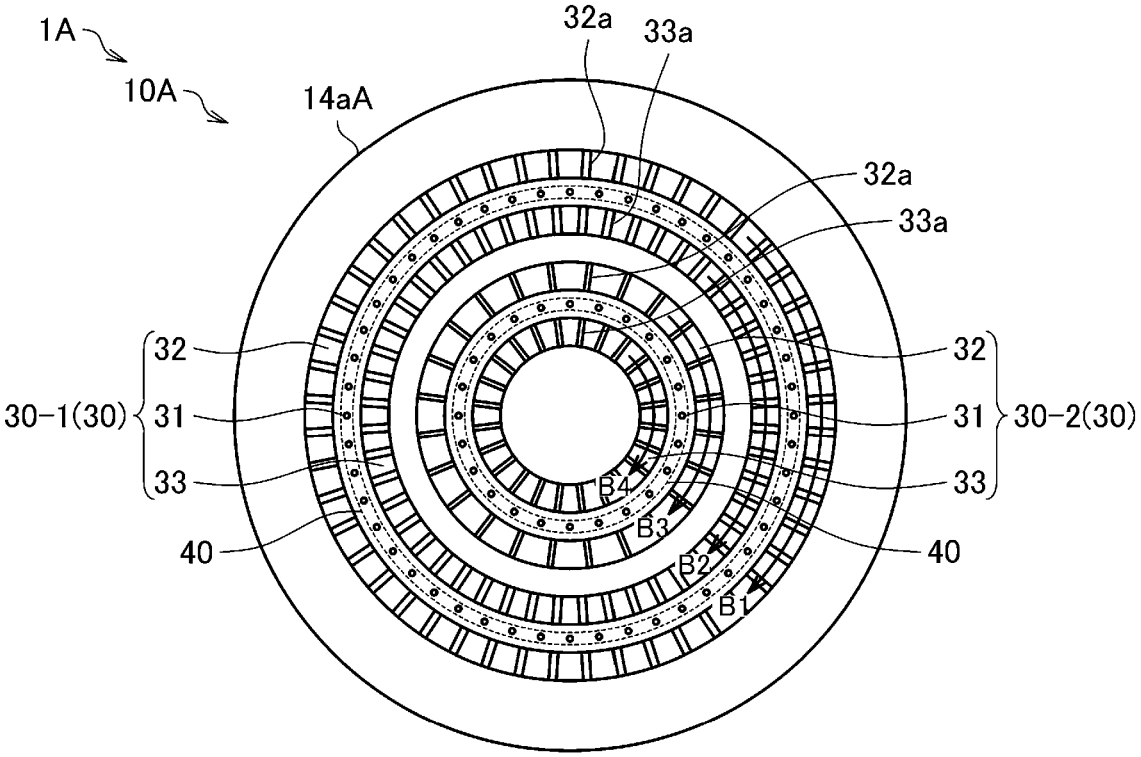
FIG. 7 is a diagram of a burner plate according to a first modification as viewed from a combustion chamber side.

FIG. 7 is a diagram of a burner plate 14*a*A according to a first modification as viewed from the combustion chamber 13*c* side. As illustrated in FIG. 7, a combustion device 10A of a gas turbine system 1A according to the first modification includes the burner plate 14*a*A.

In the burner plate 14*a*A, as compared with the burner plate 14*a* described above, in an injection hole group 30-2, the directions in which first swirling blades 32*a* and second swirling blades 33*a* are inclined with respect to the combustion-chamber-side axial direction are different.

In the first modification, the direction in which first swirling blades 32*a* and second swirling blades 33*a* are inclined with respect to the combustion-chamber-side axial direction in an injection hole group 30-1 and the direction in which the first swirling blades 32*a* and the second swirling blades 33*a* are inclined with respect to the combustion-chamber-side axial direction in the injection hole group 30-2 are on the same side in the circumferential direction.

Similarly to the burner plate 14*a* described above, the first swirling blades 32*a* and the second swirling blades 33*a* of the injection hole group 30-1 are inclined to a first side (clockwise direction in FIG. 7) in the circumferential direction with respect to the combustion-chamber-side axial direction. Therefore, as indicated by arrows B1 and B2 in FIG. 7, the air injected from a first air injection hole 32 and a second air injection hole 33 of the injection hole group 30-1 swirls to the first side in the circumferential direction in the combustion chamber 13*c*.

On the other hand, unlike the burner plate 14*a* described above, the first swirling blades 32*a* and the second swirling blades 33*a* of the injection hole group 30-2 are inclined to the first side (clockwise direction in FIG. 7) in the circumferential direction with respect to the combustion-chamber-side axial direction. Therefore, as indicated by arrows B3 and B4 in FIG. 7, the air injected from a first air injection hole 32 and a second air injection hole 33 of the injection hole group 30-2 swirls to the first side in the circumferential direction in the combustion chamber 13*c*.

As described above, in the combustion device 10A according to the first modification, the direction in which the first swirling blades 32*a* and the second swirling blades 33*a* are inclined with respect to the combustion-chamber-side axial direction in the injection hole group 30-1 and the direction in which the first swirling blades 32*a* and the second swirling blades 33*a* are inclined with respect to the combustion-chamber-side axial direction in the injection hole group 30-2 are on the same side in the circumferential direction. As a result, the swirling direction (specifically, the clockwise direction in FIG. 7,) of a swirl flow of air generated by the air injected from the injection hole group 30-1 and the swirling direction (specifically, the clockwise direction in FIG. 7,) of a swirl flow of air generated by the air injected from the injection hole group are the same. Therefore, the swirl flow of air generated by the air injected from the injection hole group and the swirl flow of air generated by the air injected from the injection hole group 30-2 enhance each other. Therefore, the swirl flow of air generated in the combustion chamber 13*c* make it easier to hold flame in the center of the swirl flow, thereby further stabilizing the flame.

Note that the inclination angles (namely, the inclination angles with respect to the combustion-chamber-side axial direction) of the first swirling blades 32*a* and the second swirling blades 33*a* of the injection hole group 30-2 may be smaller than the inclination angles of the first swirling blades 32*a* and the second swirling blades 33*a* of the injection hole group 30-1. As a result, a velocity component in the swirling direction of the swirl flow of air generated by the air injected from the injection hole group 30-2 can be easily made smaller than a velocity component in the swirling direction of the swirl flow of air generated by the air injected from the injection hole group 30-1. Therefore, a circulating flow directed toward the burner plate 14*a*A side through the vicinity of the central axis of the swirl flow is suppressed from being excessively strong, thereby preventing flame from approaching the burner plate 14*a*A.

In the above example, the first swirling blades 32*a* and the second swirling blades 33*a* of the injection hole group are inclined to the first side (clockwise direction in FIG. 7) in the circumferential direction with respect to the combustion-chamber-side axial direction. However, the first swirling blades 32*a* and the second swirling blades 33*a* of the injection hole group 30-1 may be inclined to a second side in the circumferential direction (counterclockwise direction in FIG. 7) with respect to the combustion-chamber-side axial direction. In this case, the first swirling blades 32*a* and the second swirling blades 33*a* of the injection hole group 30-2 are inclined to the second side in the circumferential direction with respect to the combustion-chamber-side axial direction.

Figure 8:
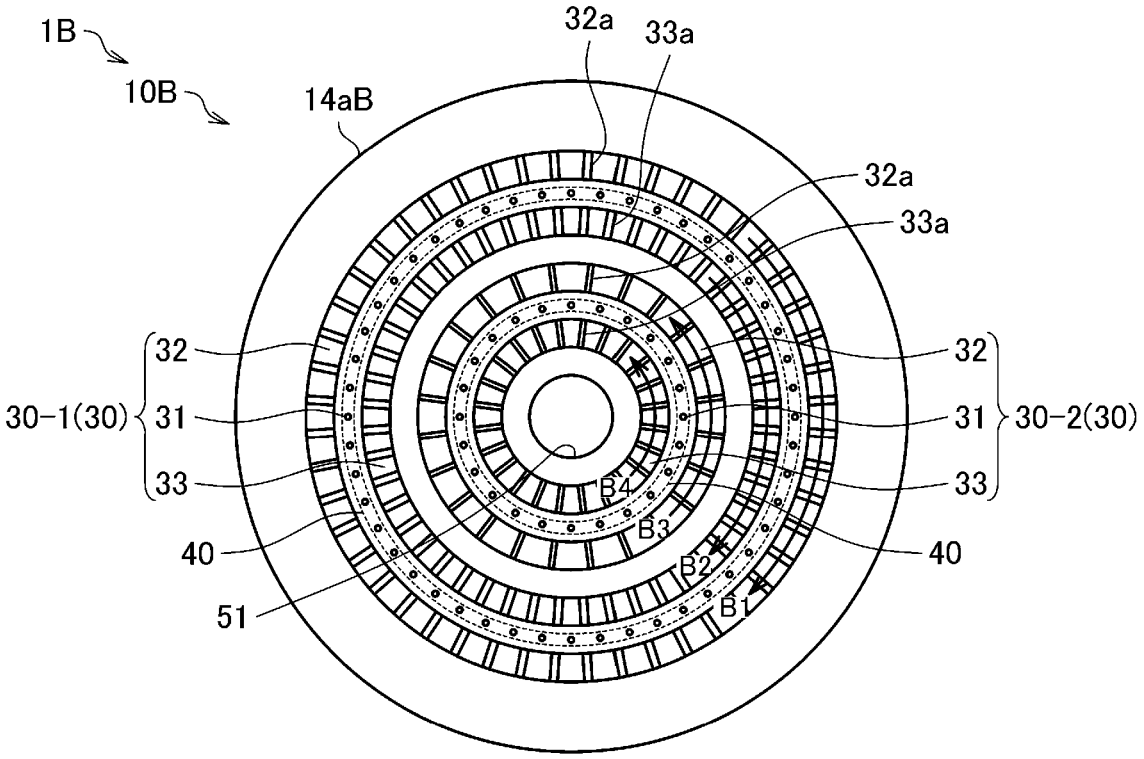
FIG. 8 is a diagram of a burner plate according to a second modification as viewed from a combustion chamber side.

FIG. 8 is a diagram of a burner plate 14*a*B according to a second modification as viewed from the combustion chamber 13*c* side. As illustrated in FIG. 8, a combustion device 10B of a gas turbine system 1B according to a second modification includes a burner plate 14*a*B.

The burner plate 14*a*B is different from the burner plate 14*a* in that a third air injection hole 51 is included.

The third air injection hole 51 faces the inside of the combustion chamber 13*c*. The third air injection hole 51 penetrates the burner plate 14*a*B from the combustion chamber 13*c* side to the side opposite to the combustion chamber 13*c* side. The third air injection hole 51 is provided on a radially inner side with respect to the injection hole group 30-2. As described above, in a case where there is a plurality of injection hole groups 30, the third air injection hole 51 is included on a radially inner side with respect to an injection hole group 30 on the radially innermost side. That is, the third air injection hole 51 is included on a radially inner side with respect to any injection hole group 30.

The third air injection hole 51 is disposed coaxially with the central axis of the combustion chamber 13*c*. However, the central axis of the third air injection hole 51 and the central axis of the combustion chamber 13*c* may not coincide with each other. The third air injection hole 51 has a columnar shape. However, the third air injection hole 51 may have a shape other than the columnar shape (for example, a polygonal prism shape or the like).

A part of the air sent to the burner plate 14*a*B through the space S in the combustor 13 is injected from the third air injection hole 51 into the combustion chamber 13*c*. The injection direction of the air injected from the third air injection hole 51 is the axial direction of the combustion chamber 13*c*. However, the injection direction of the air injected from the third air injection hole 51 may be inclined with respect to the axial direction of the combustion chamber 13*c*.

As described above, in the combustion device 10B according to the second modification, the third air injection hole 51 is included on a radially inner side with respect to the injection hole group 30-2. As a result, a circulating flow flowing toward the burner plate 14*a*B side through the vicinity of the central axis of the swirl flow can be weakened by the air injected from the third air injection hole 51. This prevents flame from approaching the burner plate 14*a*B more effectively. Therefore, erosion of the burner 14 is more effectively suppressed.

In the example of FIG. 8, the swirling direction of the swirl flow of air generated by the air injected from the injection hole group 30-1 is opposite to the swirling direction of the swirl flow of air generated by the air injected from the injection hole group 30-2. However, in the combustion device 10B, the swirling direction of the swirl flow of air generated by the air injected from the injection hole group 30-1 and the swirling direction of the swirl flow of air generated by the air injected from the injection hole group 30-2 may be the same direction.

Figure 9:
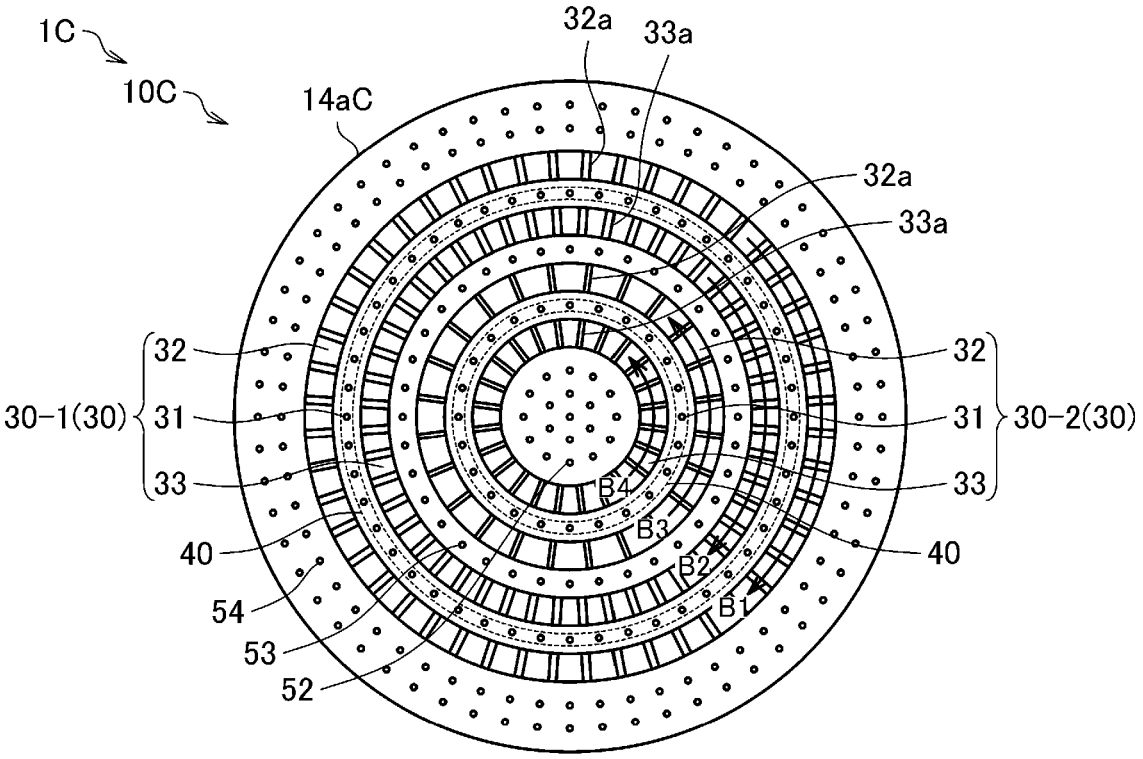
FIG. 9 is a diagram of a burner plate according to a third modification as viewed from a combustion chamber side.

FIG. 9 is a diagram of a burner plate 14*a*C according to a third modification as viewed from the combustion chamber 13*c* side. As illustrated in FIG. 9, a combustion device 10C of a gas turbine system 1C according to a third modification includes a burner plate 14*a*C.

The burner plate 14*a*C is different from the burner plate 14*a* in that a plurality of third air injection holes 52, a plurality of fourth air injection holes 53, and a plurality of fifth air injection holes 54 are included.

The third air injection holes 52, the fourth air injection holes 53, and the fifth air injection holes 54 face the inside of the combustion chamber 13*c*. The third air injection holes 52, the fourth air injection holes 53, and the fifth air injection holes 54 penetrate the burner plate 14*a*C from the combustion chamber 13*c* side to the opposite side to the combustion chamber 13*c* side. The flow path cross-sectional shapes of the third air injection holes 52, the fourth air injection holes 53, and the fifth air injection holes 54 are circular. However, the flow path cross-sectional shapes of the third air injection holes 52, the fourth air injection holes 53, and the fifth air injection holes 54 may have a shape other than the circular shape (for example, a polygonal shape or the like).

The flow path diameters of the third air injection holes 52, the fourth air injection holes 53, and the fifth air injection holes 54 are smaller than the flow path diameter of the third air injection hole 51 of the burner plate 14*a*B described above. The flow path diameters of the third air injection holes 52, the fourth air injection holes 53, and the fifth air injection holes 54 coincide with each other. However, the flow path diameters of the third air injection holes 52, the fourth air injection holes 53, and the fifth air injection holes 54 may be different from each other.

A part of the air sent to the burner plate 14$a$C through the space S in the combustor 13 is injected into the combustion chamber 13$c$ from the third air injection holes 52, the fourth air injection holes 53, and the fifth air injection holes 54. The injection direction of the air injected from the third air injection holes 52, the fourth air injection holes 53, and the fifth air injection holes 54 is the axial direction of the combustion chamber 13$c$. However, the injection direction of the air injected from the third air injection holes 52, the fourth air injection holes 53, and the fifth air injection holes 54 may be inclined with respect to the axial direction of the combustion chamber 13$c$.

The third air injection holes 52 are included on a radially inner side with respect to the injection hole group 30-2. The fourth air injection holes 53 are included on a radially inner side with respect to an injection hole group and on a radially outer side with respect to an injection hole group 30-2. The fifth air injection holes 54 are included on a radially outer side with respect to the injection hole group 30-1.

As described above, in the combustion device 10C according to the third modification, the third air injection hole 52 is included on a radially inner side with respect to the injection hole group 30-2. As a result, similarly to the combustion device 10B described above, a circulating flow flowing toward the burner plate 14$a$C side through the vicinity of the central axis of the swirl flow can be weakened by the air injected from the third air injection hole 52. This prevents flame from approaching the burner plate 14$a$C more effectively. Therefore, erosion of the burner 14 is more effectively suppressed.

Furthermore, in the combustion device 10C according to the third modification, the third air injection holes 52, the fourth air injection holes 53, and the fifth air injection holes 54 are included over a wide area in the burner plate 14$a$C. As a result, the burner plate 14$a$C is cooled by the air passing through the third air injection holes 52, the fourth air injection holes 53, and the fifth air injection holes 54.

In the example of FIG. 9, the swirling direction of a swirl flow of air generated by the air injected from the injection hole group 30-1 is opposite to the swirling direction of a swirl flow of air generated by the air injected from the injection hole group 30-2. However, in the combustion device 10C, the swirling direction of the swirl flow of air generated by the air injected from the injection hole group 30-1 and the swirling direction of the swirl flow of air generated by the air injected from the injection hole group 30-2 may be the same direction.

Figure 10:
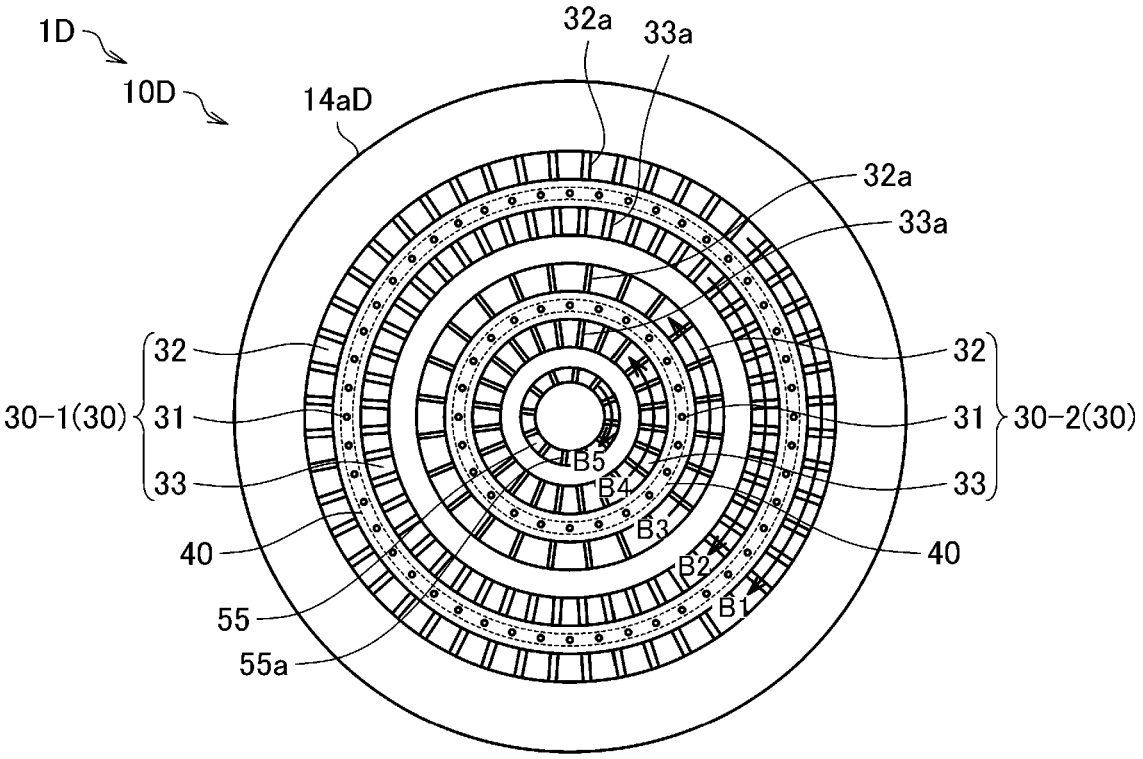
FIG. 10 is a diagram of a burner plate according to a fourth modification as viewed from a combustion chamber side.

FIG. 10 is a diagram of a burner plate 14$a$D according to a fourth modification as viewed from the combustion chamber 13$c$ side. As illustrated in FIG. 10, a combustion device 10D of a gas turbine system 1D according to the fourth modification includes the burner plate 14$a$D.

The burner plate 14$a$D is different from the burner plate 14$a$ in that a third air injection hole 55 is included.

The third air injection hole 55 faces the inside of the combustion chamber 13$c$. The third air injection hole 55 penetrates the burner plate 14$a$D from the combustion chamber 13$c$ side to the side opposite to the combustion chamber 13$c$ side. The third air injection hole 55 is provided on a radially inner side with respect to an injection hole group 30-2. The third air injection hole 55 extends in the circumferential direction and is formed in an annular shape. A part of the air sent to the burner plate 14$a$D through the space S in the combustor 13 is injected from the third air injection hole 55 into the combustion chamber 13$c$.

The third air injection hole 55 is provided with third swirling blades 55$a$ inclined in the circumferential direction with respect to the combustion-chamber-side axial direction. The third swirling blades 55$a$ have, for example, a substantially flat plate shape. A third swirling blade 55$a$ divides the third air injection hole 55 in the circumferential direction. A third swirling blade 55$a$ extends on a plane intersecting the circumferential direction. In each of the third air injection holes 55, a plurality of third swirling blades 55$a$ is provided at intervals in the circumferential direction. In the third air injection hole 55, the plurality of third swirling blades 55$a$ is provided at equal intervals. However, in the third air injection hole 55, the plurality of third swirling blades 55$a$ may be provided at unequal intervals.

The direction in which the third swirling blades 55$a$ are inclined with respect to the combustion-chamber-side axial direction in the third air injection hole 55 and the direction in which first swirling blades 32$a$ and second swirling blades 33$a$ are inclined with respect to the combustion-chamber-side axial direction in an injection hole group 30-2 adjacent to the third air injection hole 55 are on different sides in the circumferential direction. In the example of FIG. 10, the first swirling blades 32$a$ and the second swirling blades 33$a$ of the injection hole group 30-2 are inclined to the second side (counterclockwise direction in FIG. 10) in the circumferential direction with respect to the combustion-chamber-side axial direction. That is, the third swirling blade 55$a$ is inclined to the first side (clockwise direction in FIG. 10) in the circumferential direction with respect to the combustion-chamber-side axial direction. Therefore, as indicated by an arrow B5 in FIG. 10, the air injected from the third air injection hole 55 swirls to the first side in the circumferential direction in the combustion chamber 13$c$.

As described above, in the combustion device 10D according to the fourth modification, the third air injection hole 55 is included on a radially inner side with respect to the injection hole group 30-2. As a result, similarly to the combustion device 10B described above, a circulating flow flowing toward the burner plate 14$a$D side through the vicinity of the central axis of the swirl flow can be weakened by the air injected from the third air injection hole 51. This prevents flame from approaching the burner plate 14$a$D more effectively. Therefore, erosion of the burner 14 is more effectively suppressed. Furthermore, in the combustion device 10D according to the fourth modification, since a swirl flow of air is generated in the combustion chamber 13$c$ by the air injected from the third air injection hole 55, it is possible to further promote mixing of hydrogen and air.

In the combustion device 10D, as described above, the direction in which the third swirling blades 55$a$ are inclined with respect to the combustion-chamber-side axial direction in the third air injection hole 55 and the direction in which the first swirling blades 32$a$ and the second swirling blades 33$a$ are inclined with respect to the combustion-chamber-side axial direction in the injection hole group 30-2 adjacent to the third air injection hole 55 are on different sides in the circumferential direction. As a result, the swirling direction (specifically, the clockwise direction in FIG. 10) of a swirl flow of air generated by the air injected from the third air injection hole 55 and the swirling direction (specifically, the counterclockwise direction in FIG. 10) of a swirl flow of air generated by the air injected from the injection hole group 30-2 are opposite directions. Therefore, the swirl flow of air generated by the air injected from the third air injection hole 55 and the swirl flow of air generated by the air injected from the injection hole group 30-2 weaken each other. Therefore, the circulating flow passing through the vicinity of the central axis of the swirl flow toward the burner plate 14$a$D is weakened. This prevents flame from approaching the burner plate 14*a*D further effectively. Therefore, erosion of the burner 14 is further effectively suppressed. However, the third swirling blades 55*a* may not be provided in the third air injection hole 55.

In the example of FIG. 10, the swirling direction of a swirl flow of air generated by the air injected from the injection hole group 30-1 is opposite to the swirling direction of the swirl flow of air generated by the air injected from the injection hole group 30-2. However, in the combustion device 10D, the swirling direction of the swirl flow of air generated by the air injected from the injection hole group 30-1 and the swirling direction of the swirl flow of air generated by the air injected from the injection hole group 30-2 may be the same direction.

Figure 11:
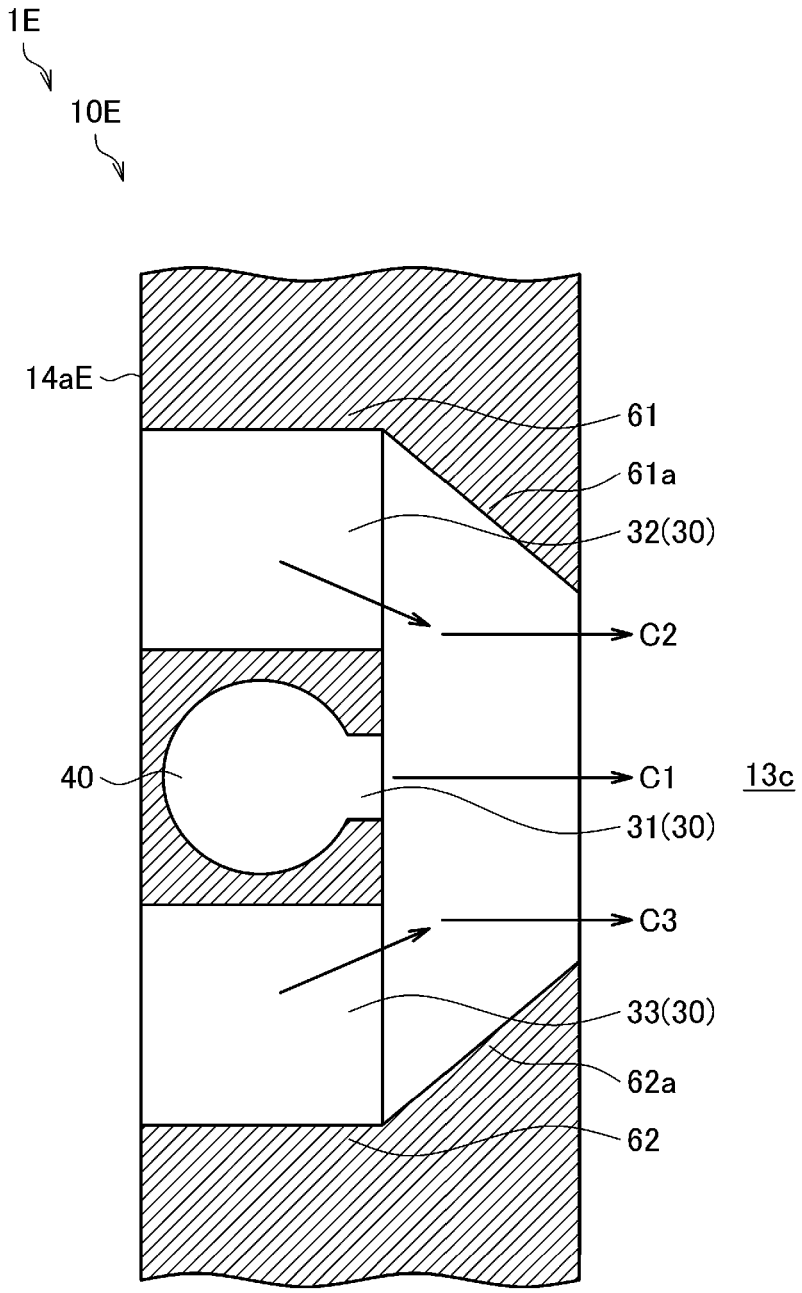
FIG. 11 is a cross-sectional view illustrating a burner plate according to a fifth modification.

FIG. 11 is a cross-sectional view illustrating a burner plate 14*a*E according to a fifth modification. As illustrated in FIG. 11, a combustion device 10E of a gas turbine system 1E according to the fifth modification includes the burner plate 14*a*E.

The burner plate 14*a*E is different from the burner plate 14*a* in the configurations of a wall portion 61 on the outer peripheral side of a first air injection hole 32 and a wall portion 62 on the inner peripheral side of a second air injection hole 33. Note that the configurations of the wall portion 61 and the wall portion 62 are similar in each of injection hole groups 30.

The wall portion 61 on the outer peripheral side of the first air injection hole 32 extends closer to the combustion chamber 13*c* than the first air injection hole 32 is. A tapered portion 61*a* is formed on the combustion chamber 13*c* side of the wall portion 61. The tapered portion 61*a* is inclined on a radially inner side with respect to the combustion-chamber-side axial direction.

The wall portion 62 on the inner peripheral side of the second air injection hole 33 extends closer to the combustion chamber 13*c* than the second air injection hole 33 is. A tapered portion 62*a* is formed on the combustion chamber 13*c* side of the wall portion 62. The tapered portion 62*a* is inclined on a radially outer side with respect to the combustion-chamber-side axial direction.

Hydrogen injected from the hydrogen injection holes 31, air injected from the first air injection hole 32, and air injected from the second air injection hole 33 are narrowed between the tapered portion 61*a* of the wall portion 61 and the tapered portion 62*a* of the wall portion 62. As a result, the flow rate of hydrogen and air increases between the tapered portion 61*a* of the wall portion 61 and the tapered portion 62*a* of the wall portion 62, thereby promoting mixing of hydrogen and air.

Note that, in a case where there is a plurality of injection hole groups 30, the tapered portion 61*a* of the wall portion 61 and the tapered portion 62*a* of the wall portion 62 may be included only in some injection hole groups 30 or may be included in all the injection hole groups 30.

The combustion device 10E is an example in which the tapered portion 61*a* of the wall portion 61 and the tapered portion 62*a* of the wall portion 62 are added to the above-described combustion device 10. However, the tapered portion 61*a* of the wall portion 61 and the tapered portion 62*a* of the wall portion 62 may be added to the combustion device 10A, the combustion device 10B, the combustion device 10C, or the combustion device 10D described above.

In the above description, examples have been described in which, in each of the injection hole groups, the directions inclined with respect to the combustion-chamber-side axial direction of the first swirling blades 32*a* and the second swirling blades 33*a* are on the same side in the circumferential direction. However, in each of the injection hole groups, the directions inclined with respect to the combustion-chamber-side axial direction of the first swirling blades 32*a* and the second swirling blades 33*a* may be on different sides in the circumferential direction. That is, in each of the injection hole groups, the second swirling blades 33*a* may be inclined to a side different from that of the first swirling blades 32*a* in the circumferential direction with respect to the combustion-chamber-side axial direction.

Figure 12:
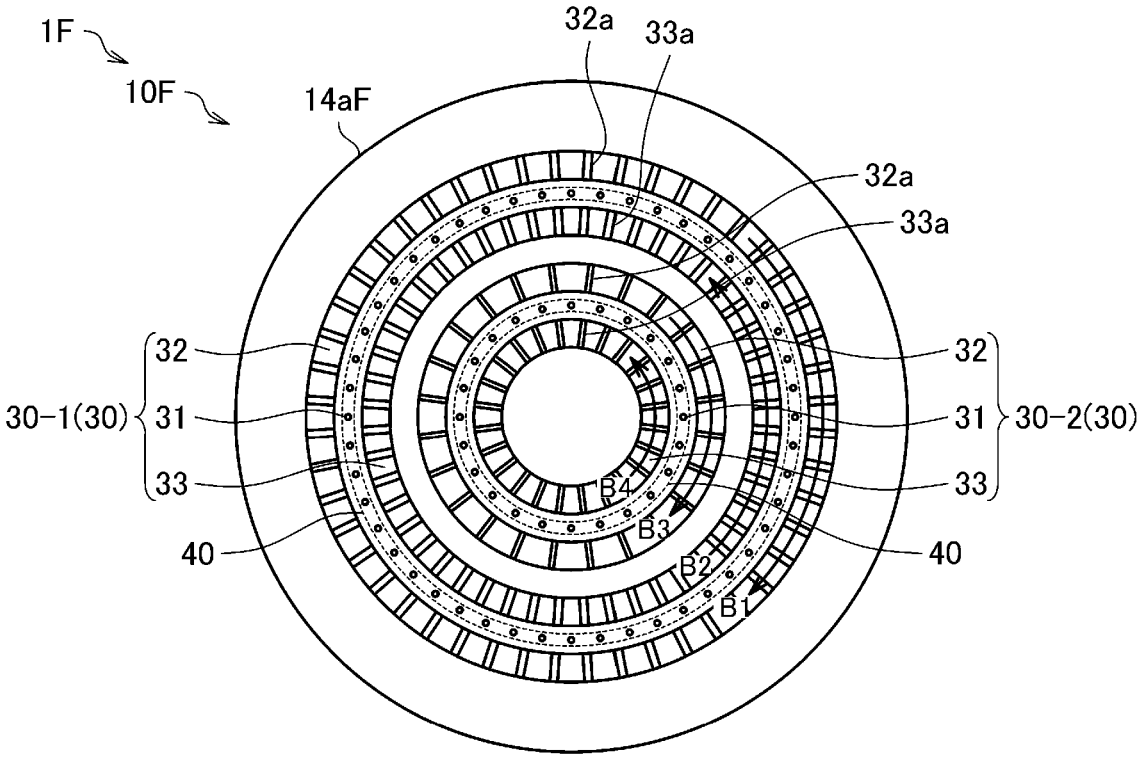
FIG. 12 is a diagram illustrating a first example in which directions inclined with respect to the combustion-chamber-side axial direction are on different sides in the circumferential direction between the first swirling blades and the second swirling blades in each of the injection hole groups.

FIG. 12 is a diagram illustrating a first example in which directions inclined with respect to the combustion-chamber-side axial direction of first swirling blades 32*a* and second swirling blades 33*a* in each of injection hole groups are on different sides in the circumferential direction. FIG. 12 illustrates the burner plate 14*a*F of a combustion device 10F of a gas turbine system 1F according to the first example as viewed from the combustion chamber 13*c* side.

In the burner plate 14*a*F, first swirling blades 32*a* of an injection hole group 30-1 are inclined to the first side in the circumferential direction (clockwise direction in FIG. 12) with respect to the combustion-chamber-side axial direction. Therefore, as indicated by an arrow B1 in FIG. 12, the air injected from a first air injection hole 32 of the injection hole group 30-1 swirls to the first side in the circumferential direction in the combustion chamber 13*c*. On the other hand, second swirling blades 33*a* of the injection hole group 30-1 are inclined to the second side in the circumferential direction (counterclockwise direction in FIG. 12) with respect to the combustion-chamber-side axial direction. Therefore, as indicated by an arrow B2 in FIG. 12, the air injected from the second air injection hole 33 of the injection hole group 30-1 swirls to the second side in the circumferential direction in the combustion chamber 13*c*.

In the burner plate 14*a*F, first swirling blades 32*a* of an injection hole group 30-2 are inclined to the first side in the circumferential direction (clockwise direction in FIG. 12) with respect to the combustion-chamber-side axial direction. Therefore, as indicated by an arrow B3 in FIG. 12, the air injected from the first air injection hole 32 of the injection hole group 30-2 swirls to the first side in the circumferential direction in the combustion chamber 13*c*. On the other hand, the second swirling blades 33*a* of the injection hole group 30-2 are inclined to the second side in the circumferential direction (counterclockwise direction in FIG. 12) with respect to the combustion-chamber-side axial direction. Therefore, as indicated by an arrow B4 in FIG. 12, the air injected from the second air injection hole 33 of the injection hole group 30-2 swirls to the second side in the circumferential direction in the combustion chamber 13*c*.

In the combustion device 10F, in each of the injection hole groups, directions in which the first swirling blades 32*a* and the second swirling blades 33*a* are inclined with respect to the combustion-chamber-side axial direction are on different sides in the circumferential direction. As a result, in each of the injection hole groups, hydrogen injected from the hydrogen injection holes 31 receives turning forces on different sides in the circumferential direction between a radially inner side and a radially outer side. Therefore, in each of the injection hole groups, hydrogen injected from the hydrogen injection holes 31 is rapidly mixed with air by a swirl flow of air generated by the air injected from the first air injection hole 32 and the second air injection hole 33. As a result, as compared with a case where hydrogen and air are supplied to the combustion chamber 13*c* in a state of being mixed in advance, the ignition position is on the inner side of the combustion chamber 13*c*, and thus backfire is suppressed. Therefore, the burner 14 can be protected from flame.

Furthermore, in the combustion device 10F, directions inclined with respect to the combustion-chamber-side axial direction of the second swirling blades 33*a* of the injection hole group 30-1 and the first swirling blades 32*a* of the injection hole group 30-2 are on different sides in the circumferential direction. As a result, the swirling direction (specifically, the counterclockwise direction in FIG. 12) of a swirl flow of air generated by the air injected from the second swirling blades 33*a* of the injection hole group 30-1 and the swirling direction (specifically, the clockwise direction in FIG. 12) of a swirl flow of air generated by the air injected from the first swirling blades 32*a* of the injection hole group 30-2 are opposite directions. Therefore, the swirl flow of air generated by the air injected from the second swirling blades 33*a* of the injection hole group 30-1 and the swirl flow of air generated by the air injected from the first swirling blades 32*a* of the injection hole group 30-2 weaken each other. Therefore, a circulating flow (namely, a flow indicated by an arrow D2 in FIG. 6) passing through the vicinity of the central axis of the swirl flow toward the burner plate 14*a*F side is weakened. This prevents flame from approaching the burner plate 14*a*F. Therefore, erosion of the burner 14 is suppressed.

Figure 13:
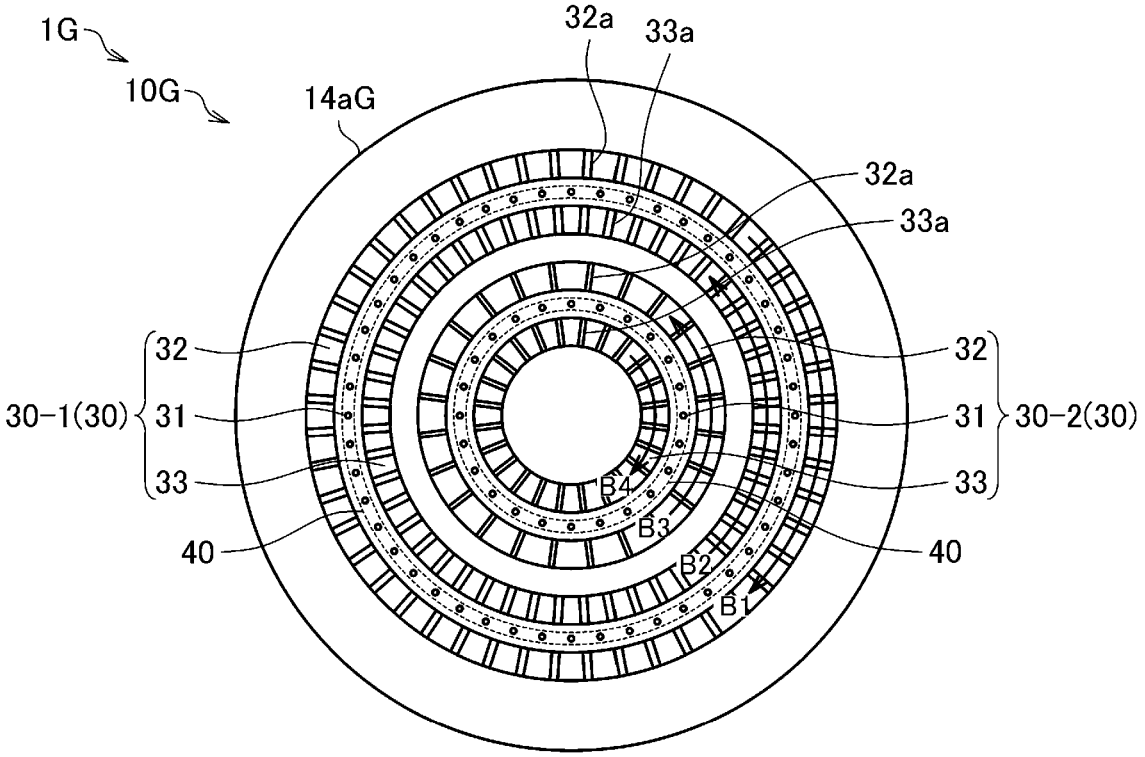
FIG. 13 is a diagram illustrating a second example in which directions inclined with respect to the combustion-chamber-side axial direction are on different sides in the circumferential direction between the first swirling blades and the second swirling blades in each of the injection hole groups.

FIG. 13 is a diagram illustrating a second example in which directions inclined with respect to the combustion-chamber-side axial direction of the first swirling blades 32*a* and the second swirling blades 33*a* in each of the injection hole groups are different sides in the circumferential direction. FIG. 13 illustrates a burner plate 14*a*G of a combustion device 10G of a gas turbine system 1G according to the second example as viewed from the combustion chamber 13*c* side.

In the burner plate 14*a*G, first swirling blades 32*a* of an injection hole group 30-1 are inclined to the first side in the circumferential direction (clockwise direction in FIG. 13) with respect to the combustion-chamber-side axial direction. Therefore, as indicated by an arrow B1 in FIG. 13, the air injected from a first air injection hole 32 of the injection hole group 30-1 swirls to the first side in the circumferential direction in the combustion chamber 13*c*. On the other hand, the second swirling blades 33*a* of the injection hole group 30-1 are inclined to the second side in the circumferential direction (counterclockwise direction in FIG. 13) with respect to the combustion-chamber-side axial direction. Therefore, as indicated by an arrow B2 in FIG. 13, the air injected from a second air injection hole 33 of the injection hole group 30-1 swirls to the second side in the circumferential direction in the combustion chamber 13*c*.

In the burner plate 14*a*G, first swirling blades 32*a* of the injection hole group 30-2 are inclined to the second side in the circumferential direction (counterclockwise direction in FIG. 13) with respect to the combustion-chamber-side axial direction. Therefore, as indicated by an arrow B3 in FIG. 13, the air injected from a first air injection hole 32 of the injection hole group 30-2 swirls to the second side in the circumferential direction in the combustion chamber 13*c*. On the other hand, second swirling blades 33*a* of the injection hole group 30-2 are inclined to the first side (clockwise direction in FIG. 13) in the circumferential direction with respect to the combustion-chamber-side axial direction. Therefore, as indicated by an arrow B4 in FIG. 13, the air injected from the second air injection hole 33 of the injection hole group 30-2 swirls to the first side in the circumferential direction in the combustion chamber 13*c*.

In the combustion device 10G, similarly to the combustion device 10F, in each of the injection hole groups, directions inclined with respect to the combustion-chamber-side axial direction of the first swirling blades 32*a* and the second swirling blades 33*a* are on different sides in the circumferential direction. As a result, similarly to the combustion device 10F, in each of the injection hole groups, hydrogen injected from hydrogen injection holes 31 is rapidly mixed with air by the swirl flows of air generated by the air injected from the first air injection hole 32 and the second air injection hole 33, thereby suppressing backfire.

Furthermore, in the combustion device 10G, the directions inclined with respect to the combustion-chamber-side axial direction of the second swirling blades 33*a* of the injection hole group 30-1 and the first swirling blades 32*a* of the injection hole group 30-2 are on the same side in the circumferential direction. As a result, the swirling direction (specifically, the counterclockwise direction in FIG. 13) of a swirl flow of air generated by the air injected from the second swirling blades 33*a* of the injection hole group 30-1 and the swirling direction (specifically, the counterclockwise direction in FIG. 13) of a swirl flow of air generated by the air injected from the first swirling blades 32*a* of the injection hole group 30-2 are the same direction. Therefore, the swirl flow of air generated by the air injected from the second swirling blades 33*a* of the injection hole group 30-1 and the swirl flow of air generated by the air injected from the first swirling blades 32*a* of the injection hole group 30-2 strengthen each other. However, in each of the injection hole groups, a swirl flow of air generated by air injected from first swirling blades 32*a* and a swirl flow of air generated by air injected from second swirling blades 33*a* weaken each other. Therefore, a circulating flow (namely, a flow indicated by an arrow D2 in FIG. 6) passing through the vicinity of the central axis of the swirl flow toward the burner plate 14*a*G side is stronger than that in the example of FIG. 12 but is not excessively strong.

Note that the third air injection hole 51 illustrated in the example of FIG. 8, the third air injection holes 52, the fourth air injection holes 53, and the fifth air injection holes 54 illustrated in the example of FIG. 9, the third air injection hole 55 illustrated in the example of FIG. 10, the tapered portion 61*a* of the wall portion 61 and the tapered portion 62*a* of the wall portion 62 illustrated in the example of FIG. 11 may be each added to the combustion device 10F of FIG. 12 and the combustion device 10G of FIG. 13.

Although the embodiments of the present disclosure have been described with reference to the accompanying drawings, it is naturally understood that the present disclosure is not limited to the above embodiments. It is clear that those skilled in the art can conceive various modifications or variations within the scope described in the claims, and it is understood that they are naturally also within the technical scope of the present disclosure.

In the gas turbine system 1, the gas turbine system 1A, the gas turbine system 1B, the gas turbine system 1C, the gas turbine system 1D, the gas turbine system 1E, the gas turbine system 1F, and the gas turbine system 1G, the examples in which the rotational power generated by the turbocharger 11 is used as the energy for driving the generator 12 has been described above. However, in the gas turbine system 1, the gas turbine system 1A, the gas turbine system 1B, the gas turbine system 1C, the gas turbine system 1D, the gas turbine system 1E, the gas turbine system 1F, and the gas turbine system 1G, the rotational power generated by the turbocharger 11 may be used for other applications (for example, for the purpose of driving a mobile body such as a ship).

In the above description, the examples have been described in which the shape of the combustion chamber 13*c* is substantially cylindrical. However, the shape of the combustion chamber 13*c* is not limited to this example. For example, the combustion chamber 13*c* may be a substantially cylindrical space. The shapes of the burner plate 14*a*, the burner plate 14*a*A, the burner plate 14*a*B, the burner plate 14*a*C, the burner plate 14*a*D, the burner plate 14*a*E, the burner plate 14*a*F, and the burner plate 14*a*G can be modified as appropriate depending on the shape of the combustion chamber 13*c*.

In the example of FIG. 1 described above, the air sent from the compressor 11*a* to the combustor 13 passes between the outer curved surface of the liner 13*b* and the inner curved surface of the casing 13*a* and then is sent to the combustion chamber 13*c*. However, the path of the air sent from the compressor 11*a* to the combustor 13 is not limited to this example (namely, the reverse-flow type).

The invention claimed is:

1. A combustion device comprising:

a combustion chamber;

a first injection hole group including:

a first plurality of hydrogen injection holes facing inside of the combustion chamber, the first plurality of hydrogen injection holes being provided apart from one another at intervals in a circumferential direction of the combustion chamber;

a first outer air injection hole facing the inside of the combustion chamber and extending in the circumferential direction on a radially outer side with respect to the first plurality of hydrogen injection holes, the first outer air injection hole being annular; and a first inner air injection hole facing the inside of the combustion chamber and extending in the circumferential direction on a radially inner side with respect to the first plurality of hydrogen injection holes, the first inner air injection hole being annular;

a second injection hole group including:

a second plurality of hydrogen injection holes facing inside of the combustion chamber, the second plurality of hydrogen injection holes being provided apart from one another at intervals in the circumferential direction of the combustion chamber;

a second outer air injection hole facing the inside of the combustion chamber and extending in the circumferential direction on a radially outer side with respect to the second plurality of hydrogen injection holes, the second outer air injection hole being annular; and a second inner air injection hole facing the inside of the combustion chamber and extending in the circumferential direction on a radially inner side with respect to the second plurality of hydrogen injection holes, the second inner air injection hole being annular;

wherein the first injection hole group is provided on a radially outer side with respect to the second injection hole group;

a first outer swirling blade provided in the first outer air injection hole and inclined in the circumferential direction with respect to a combustion-chamber-side axial direction, the combustion-chamber-side axial direction being a part of an axial direction of the combustion chamber, the part facing the combustion chamber;

a first inner swirling blade provided in the first inner air injection hole and inclined to a same side as the first outer swirling blade in the circumferential direction with respect to the combustion-chamber-side axial direction;

a second outer swirling blade provided in the second outer air injection hole and inclined in the circumferential direction with respect to the combustion-chamber-side axial direction; and a second inner swirling blade provided in the second inner air injection hole and inclined to a same side as the second outer swirling blade in the circumferential direction with respect to the combustion-chamber-side axial direction.

2. The combustion device according to claim 1, wherein a direction in which the first outer swirling blade and the first inner swirling blade are inclined with respect to the combustion-chamber-side axial direction and a direction in which the second outer swirling blade and the second inner swirling blade are inclined with respect to the combustion-chamber-side axial direction are on different sides in the circumferential direction.

3. The combustion device according to claim 1, wherein a direction in which the first outer swirling blade and the first inner swirling blade are inclined with respect to the combustion-chamber-side axial direction and a direction in which the second outer swirling blade and the second inner swirling blade are inclined with respect to the combustion-chamber-side axial direction are on a same side in the circumferential direction.

4. The combustion device according to claim 1, further comprising:

a third air injection hole provided on a radially inner side with respect to the second injection hole group, the third air injection hole facing the inside of the combustion chamber.

5. The combustion device according to claim 2, further comprising:

a third air injection hole provided on a radially inner side with respect to the second injection hole group, the third air injection hole facing the inside of the combustion chamber.

6. The combustion device according to claim 3, further comprising:

a third air injection hole provided on a radially inner side with respect to the second injection hole group, the third air injection hole facing the inside of the combustion chamber.

7. The combustion device according to claim 4, wherein the third air injection hole extends in the circumferential direction, the third air injection hole formed in an annular shape, and the third air injection hole is provided with a third swirling blade inclined in the circumferential direction with respect to the combustion-chamber-side axial direction.

8. The combustion device according to claim 5, wherein the third air injection hole extends in the circumferential direction, the third air injection hole formed in an annular shape, and the third air injection hole is provided with a third swirling blade inclined in the circumferential direction with respect to the combustion-chamber-side axial direction.

9. The combustion device according to claim 6, wherein the third air injection hole extends in the circumferential direction, the third air injection hole formed in an annular shape, and the third air injection hole is provided with a third swirling blade inclined in the circumferential direction with respect to the combustion-chamber-side axial direction.

10. The combustion device according to claim 7, wherein a direction in which the third swirling blade is inclined with respect to the combustion-chamber-side axial direction in the third air injection hole and a direction in which the second outer swirling blade and the second inner swirling blade are inclined with respect to the combustion-chamber-side axial direction are on different sides in the circumferential direction.

11. The combustion device according to claim 8, wherein a direction in which the third swirling blade is inclined with respect to the combustion-chamber-side axial direction in the third air injection hole and a direction in which the second outer swirling blade and the second inner swirling blade are inclined with respect to the combustion-chamber-side axial direction are on different sides in the circumferential direction.

12. The combustion device according to claim 9, wherein a direction in which the third swirling blade is inclined with respect to the combustion-chamber-side axial direction in the third air injection hole and a direction in which the second outer swirling blade and the second inner swirling blade are inclined with respect to the combustion-chamber-side axial direction are on different sides in the circumferential direction.

13. The combustion device according to claim 1, further comprising:

a burner plate that closes an end of the combustion chamber, wherein the first and second injection hole groups are formed in the burner plate.

14. The combustion device according to claim 13, wherein a manifold communicating with the plurality of hydrogen injection holes is formed in the burner plate.

15. A gas turbine system comprising:

the combustion device according to claim 1.

* * * * *